US012566008B2

(12) United States Patent
Kagitani et al.

(10) Patent No.: US 12,566,008 B2
(45) Date of Patent: Mar. 3, 2026

(54) METHOD FOR CONTROLLING FAN COIL UNITS AND METHOD FOR CALCULATING HEAT TRANSFER AMOUNT

(71) Applicant: Kojimachi Engineering Co., Ltd., Tokyo (JP)

(72) Inventors: Michio Kagitani, Kanagawa (JP); Isao Okayasu, Kanagawa (JP); Munemasa Kobayashi, Kanagawa (JP)

(73) Assignee: Kojimachi Engineering Co., Ltd., Tokyo (JP)

( * ) Notice: Subject to any disclaimer, the term of this patent is extended or adjusted under 35 U.S.C. 154(b) by 397 days.

(21) Appl. No.: 18/554,105

(22) PCT Filed: Mar. 2, 2022

(86) PCT No.: PCT/JP2022/008806

§ 371 (c)(1),
(2) Date: Oct. 5, 2023

(87) PCT Pub. No.: WO2022/215392

PCT Pub. Date: Oct. 13, 2022

(65) Prior Publication Data

US 2024/0353133 A1 Oct. 24, 2024

(30) Foreign Application Priority Data

Apr. 6, 2021 (JP) ..... 2021-064690

(51) Int. Cl.
*F24F 11/46* (2018.01)
*F24F 11/63* (2018.01)
(Continued)

(52) U.S. Cl.
CPC ..... *F24F 11/46* (2018.01); *F24F 11/63* (2018.01); *F24F 2110/10* (2018.01); *F24F 2140/50* (2018.01)

(58) Field of Classification Search
None
See application file for complete search history.

(56) References Cited

U.S. PATENT DOCUMENTS 9,874,360 B2 * 1/2018 Hamada ..... F24F 1/0035
2014/0242899 A1 * 8/2014 Liu ..... F24F 11/76 454/258

FOREIGN PATENT DOCUMENTS

JP 2004309032 11/2004
JP 2006029607 2/2006
(Continued)

OTHER PUBLICATIONS

International Search Report of the Japan Patent Office in Japanese PCT application No. PCT/JP2022/008806 issued on May 24, 2022, which is an international application to which this application claims priority.

*Primary Examiner* — Mohammad Ali
(74) *Attorney, Agent, or Firm* — Kolitch Romano Dascenzo Gates LLP

(57) ABSTRACT

A method for controlling fan coil units is provided which is simple and can efficiently use cold water or hot water considering a heat load in a perimeter zone. The method is a method for controlling the fan coil units installed in the perimeter zone and includes a first step of dividing the fan coil units into groups based on a direction of an installation position of each fan coil unit and determining a predetermined drawn-air temperature setting for each group in advance and a second step of, during operation of the fan coil units, controlling supply of cold water or hot water to each fan coil unit and stop of the supply in accordance with the drawn-air temperature setting determined in advance for each group. The first step includes a third step of calculating a heat load in each direction in the perimeter zone and a fourth step of determining the drawn-air temperature setting
(Continued)

for each group in accordance with the heat load having been calculated.

5 Claims, 12 Drawing Sheets

(51) Int. Cl.
*F24F 110/10* (2018.01)
*F24F 140/50* (2018.01)

(56) References Cited

FOREIGN PATENT DOCUMENTS

| | | |
|---|---|---|
| JP | 2009175952 | 8/2009 |
| JP | 2011220638 | 11/2011 |
| JP | 2014010732 | 1/2014 |
| JP | 6300308 | 3/2018 |
| JP | 2019100680 | 6/2019 |
| JP | 2020197345 | 12/2020 |
| JP | 2021014949 | 2/2021 |

* cited by examiner

DETERMINATION FLOW OF SET DRAWN-AIR TEMPERATURE T3 OF FCU

DURING COOLING (SOUTHEAST): TEMPERATURE CHANGE ΔTL(°C)
CAUSED BY HEAT LOAD (ENTERING HEAT) AND SET DRAWN-AIR TEMPERATURE T3(°C)

(T3=t4+ΔTL, T1=7°C, t4=17°C)

DURING COOLING (NORTHWEST): TEMPERATURE CHANGE ΔTL(°C)
CAUSED BY HEAT LOAD (ENTERING HEAT) AND SET DRAWN-AIR TEMPERATURE T3(°C)
(T3=t4+ΔTL, T1=7°C, t4=17°C)

DURING HEATING (SOUTHEAST): TEMPERATURE CHANGE ΔTL(°C)
CAUSED BY HEAT LOAD (EXITING HEAT) AND SET DRAWN-AIR TEMPERATURE T3(°C)
(T3=t4+ΔTL, T1=50°C, t4=26°C)

DURING HEATING (NORTHWEST): TEMPERATURE CHANGE ΔTL(°C)
CAUSED BY HEAT LOAD (EXITING HEAT) AND SET DRAWN-AIR TEMPERATURE T3(°C)
(T3=t4+ΔTL, T1=50°C, t4=26°C)

METHOD FOR CONTROLLING FAN COIL UNITS AND METHOD FOR CALCULATING HEAT TRANSFER AMOUNT

FIELD

The present disclosure relates to a method for controlling fan coil units installed in a perimeter zone and a method for calculating a heat transfer amount.

BACKGROUND

A central air-conditioning system that is air-conditioning equipment for medium-scale and large-scale buildings uses an air handling unit, a fan coil unit, and the like. A wide floor is generally divided into a perimeter zone that is a window-side zone easily affected by outside air and an interior zone hardly affected by the outside air. The fan coil units are installed in the perimeter zone in which the temperature cannot be controlled by the air handling unit alone. Each fan coil unit takes in indoor air and blows out the air that has been heat-exchanged with cold water or hot water in a heat exchange coil, thereby adjusting the temperature in the perimeter zone.

General methods for controlling fan coil units control supply of cool water or hot water to realize the set indoor temperature (a design specification value) constant over the entire period of cooling or heating. These methods do not consider a heat load in the perimeter zone, resulting in a period in which the cold water or hot water is wasted.

A method for controlling operation of a fan coil unit described in Patent Literature 1 executes inverter control of operation of a cold and hot water pump or the like based on a heat load obtained from a difference signal between a set indoor temperature and an actual temperature measured by an indoor temperature sensor.

CITATION LIST

Patent Literatures

Patent Literature 1: Japanese Patent Application Laid-open No. 2004-309032

SUMMARY

Technical Problem

Since the method for controlling operation of a fan coil unit in Patent Literature 1 executes real time inverter control, it requires a control device provided with an advanced control program and cannot be applied to an existing control device for a fan coil unit as it is.

Considering the circumstances described above, it is an object of the present disclosure to provide a method for controlling a fan coil unit that is simple and can efficiently use cold water or hot water considering a heat load in a perimeter zone.

Solution to Problem

In order to achieve the above object, the present disclosure provides the following configurations. Numerals in parentheses are reference signs in the drawings described later and denoted for reference.

An aspect of the present disclosure provides a method for controlling a plurality of fan coil units installed in a perimeter zone, each including a heat exchange coil (11) to which cold water or hot water is supplied and being configured to draw indoor air, cause the drawn air to be heat-exchanged with the cold water or hot water in the heat exchange coil (11), and thereafter blow out the drawn air into a room, the method comprising:

a first step of dividing the fan coil units into groups based on a direction of an installation position of each of the fan coil units and determining a predetermined drawn-air temperature setting (T3) for each of the groups in advance before operation of the fan coil units; and a second step of, during the operation of the fan coil units, detecting a drawn-air temperature (t3) for each of the groups and controlling supply of the cold water or hot water to each of the fan coil units and stop of the supply to make the drawn-air temperature (t3) coincident with the drawn-air temperature setting (T3) determined in advance for each of the groups, wherein the first step includes a third step of calculating a heat load ($H_L$) in each direction in the perimeter zone, and a fourth step of determining the drawn-air temperature setting (T3) for the each group in accordance with the heat load ($H_L$) having been calculated.

It is preferred in the control method that the first step includes determining the drawn-air temperature setting (T3) for each of a period of cooling and a period of heating.

It is preferred in the control method that the first step includes determining the drawn-air temperature setting (T3) in each time zone of a day, and the second step includes setting the drawn-air temperature setting (T3) in each time zone, which has been determined in advance, before operation of the fan coil units and thereafter causing the fan coil units to operate.

It is preferred in the control method that the first step includes determining the drawn-air temperature setting (T3) for each of days of different weather types, and the second step includes setting the drawn-air temperature setting (T3), which has been determined in advance in accordance with a weather on a day when the fan coil units are caused to operate, before the operation of the fan coil units and thereafter causing the fan coil units to operate.

It is preferred in the control method that the fourth step includes a step of calculating an indoor temperature change ($\Delta T_L$) caused by the heat load ($H_L$), and a step of determining, as the drawn-air temperature setting (T3), a temperature higher than a rough standard for a blown-air temperature (t4) of the fan coil units by the indoor temperature change ($\Delta T_L$) while cooling is performed and a temperature lower than the rough standard for the blown-air temperature (t4) of the fan coil units by the indoor temperature change ($\Delta T_L$) while heating is performed.

It is preferred in the control method that the first step includes determining a set temperature (T1) of the cold water or hot water supplied to the fan coil units.

Another aspect of the present disclosure provides a method for calculating an amount of heat transfer (H) from water flowing through a heat exchange coil to air in a fan coil unit to which the control method described above is applied, the calculating method comprising:

a step of calculating a first temperature difference ($\Delta tw_0$) that is a temperature change of the water between an inlet and an outlet of the fan coil unit by using a design specification value ($H_0$) of the heat transfer amount, a water amount of the cold water or hot water (L), and a specific heat (ρw) of the water;

a step of calculating a second temperature difference ($\Delta Ti_0$) that is a difference between design specification values ($T1_0$, $T3_0$) of a water temperature setting and the drawn-air temperature setting by using the water temperature setting and the drawn-air temperature setting;

a step of calculating a first coefficient (γw) that is a ratio of the first temperature difference ($\Delta tw_0$) and the second temperature difference ($\Delta Ti_0$); and a step of, when one or both of the water temperature setting and the drawn-air temperature setting are changed to a value (T1, T3) other than the design specification values, obtaining the heat transfer amount (H) by heat transfer amount($H$)=water amount($L$)×specific heat(ρ$w$) of water×first coefficient(γ$w$)×second temperature difference(Δ$Ti$) after change.

Still another aspect of the present disclosure provides a method for calculating an amount of heat transfer (H) from water flowing through a heat exchange coil to air in a fan coil unit to which the control method described above is applied, the calculating method comprising:

a step of calculating a first temperature difference ($\Delta ta_0$) that is a temperature change of the air between an inlet and an outlet of the fan coil unit by using a design specification value ($H_0$) of the heat transfer amount, an air volume (Q), and a specific heat (ρa) of the air;

a step of calculating a second temperature difference ($\Delta Ti_0$) that is a difference between design specification values ($T1_0$, $T3_0$) of a water temperature setting and the drawn-air temperature setting by using the water temperature setting and the drawn-air temperature setting;

a step of calculating a second coefficient (γa) that is a ratio of the first temperature difference ($\Delta ta_0$) and the second temperature difference ($\Delta Ti_0$); and a step of, when one or both of the water temperature setting and the drawn-air temperature setting are changed to a value (T1, T3) other than the design specification values, obtaining the heat transfer amount (H) by heat transfer amount($H$)=air volume($Q$)×specific heat (ρ$a$) of air×second coefficient(γ$a$)×second temperature difference(Δ$Ti$) after change.

Advantageous Effects of Invention

According to the present disclosure, a drawn-air temperature setting in a fan coil unit is determined in advance considering a heat load in each direction in a perimeter zone. Accordingly, heat consumption energy of cold water or hot water supplied to the fan coil unit can be reduced. The control method of the present disclosure is a simple method that changes the drawn-air temperature setting from its design specification value and sets it in an appropriate manner, and therefore can be applied to an existing control system for a fan coil unit easily.

DETAILED DESCRIPTION

Embodiments of the present disclosure will be described below in detail with reference to the drawings.

(1) Overall Configuration of Air-Conditioning System

Figure 1:
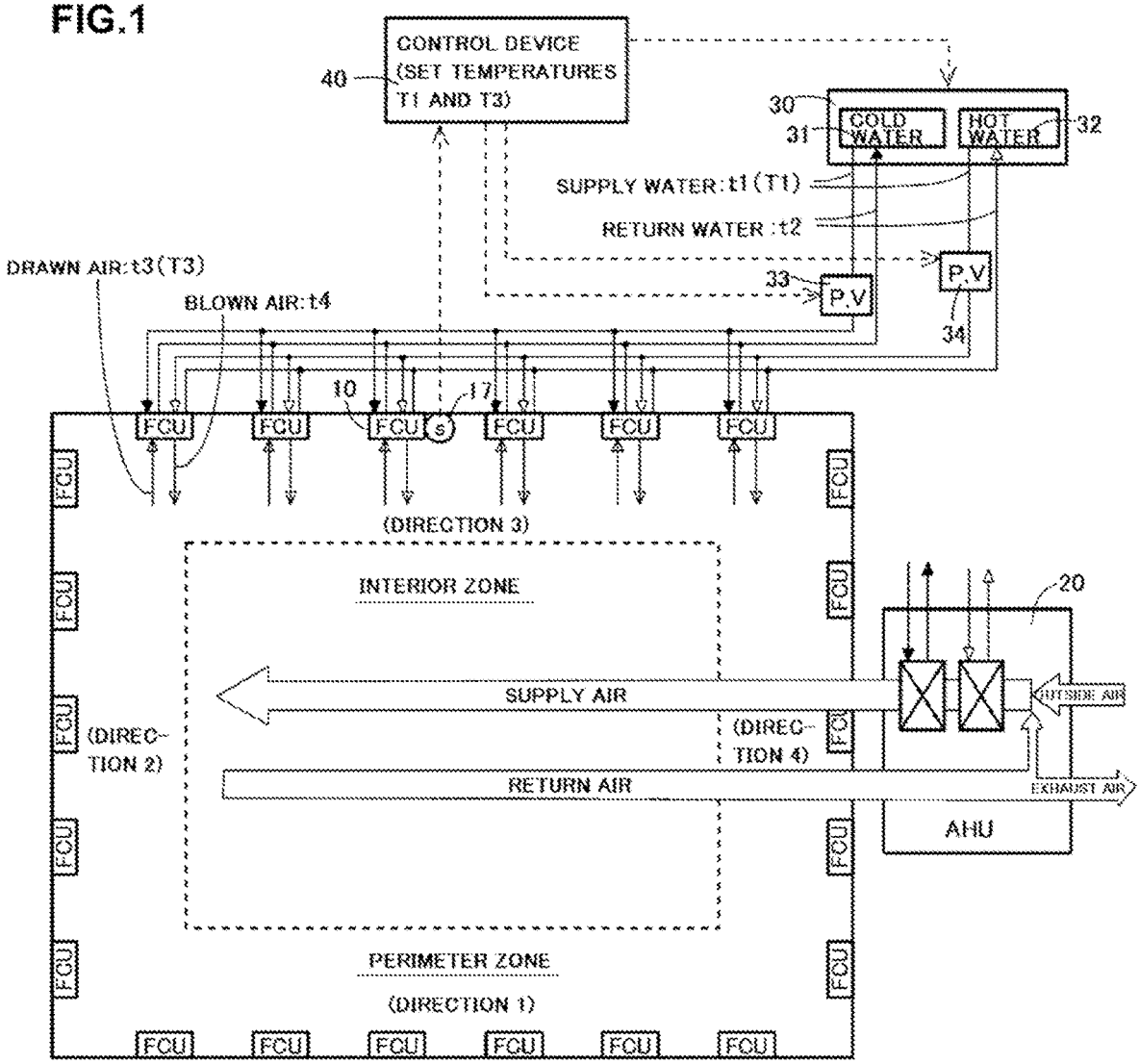
FIG. 1 is a diagram schematically illustrating an example of an overall configuration of an air-conditioning system including a fan coil unit (FCU).

FIG. 1 is a diagram schematically illustrating an example of an overall configuration of a central air-conditioning system including a fan coil unit (hereinafter, also "FCU"). One floor of a building illustrated in FIG. 1 in plan view is substantially rectangular and includes an interior zone and a perimeter zone surrounding the interior zone. The perimeter zone is easily affected by outside air. In the illustrated example, a plurality of FCUs 10 are installed at a predetermined interval along windows in the perimeter zone. An air handling unit (AHU) 20 adjusts the temperature of the outside air taken in by heat exchange with cold water or hot water and supplies the air as supply air to each floor. The FCU 10 executes temperature control in the perimeter zone in which the temperature cannot be sufficiently controlled by the AHU 20 alone. The FCU 10 draws indoor air, causes the air to be heat-exchanged with the cold water or hot water, and then blows out the air into a room. The FCU 10 only circulates the indoor air. In the present specification, "water" means both the cold water and the hot water.

In the present disclosure, the FCUs 10 installed in the perimeter zone are divided into a plurality of groups. One or a plurality of corresponding FCUs included in the respective groups are located at positions in the perimeter zone which are affected by the outside air to substantially the same degree. It is preferable that all the FCUs 10 are divided into groups based on the facing direction of a window or a wall adjacent to the installation position of each FCU 10. In this example, there are four FCU groups including groups of directions 1 to 4. For example, the four directions are east, west, south, and north. The way of setting the directions, the number of groups, and the number of FCUs included in one group can be determined depending on the state of the perimeter zone in an appropriate manner. For example, two directions including south and north may be employed. In another example, eight directions may be employed. Furthermore, a plurality of the FCUs 10 installed in one direction may be divided into groups, for example. A control device 40 controls the FCUs 10 in one group collectively. The FCUs 10 in one group are thus controlled in the same manner based on the same set value.

FIG. 1 illustrates flows of cold water, hot water, and air and a flow of control in a simplified manner only for six FCUs 10 installed in the direction 3 in the perimeter zone. The same applies to the groups of other directions, although they are not illustrated.

A heat source device 30 has a cold water source 31 and a hot water source 32. The FCUs 10 receive supply of cold water or hot water as supply water from the heat source device 30. The cold water or hot water is heat-exchanged with air in each FCU 10 and thereafter returns to the heat source device 30 as return water. The control device 40 controls the heat source device 30 to maintain a supply-water temperature t1 at a set temperature T1. A return-water temperature t2 is a temperature after heat exchange in each FCU 10. Appropriate pumps and valves denoted by reference signs 33 and 34 are provided between the heat source device 30 and the FCUs 10. The control device 40 controls the pumps and the valves, thereby controlling supply of the cold water or hot water to the FCUs 10 and stop of the supply.

A temperature sensor 17 is provided for each group, for detecting a drawn-air temperature t3 in the FCUs 10 included in that group. Detected data of the drawn-air temperature t3 is sent to the control device 40. The control device 40 compares the drawn-air temperature t3 with a drawn-air temperature setting T3 that has been preset and controls the supply of the cold water or hot water and stop of the supply to make both the compared temperatures coincident with each other. Drawn air is heat-exchanged in the FCUs 10 and then exits from the FCUs 10 as blown air at a temperature t4.

Figure 2:
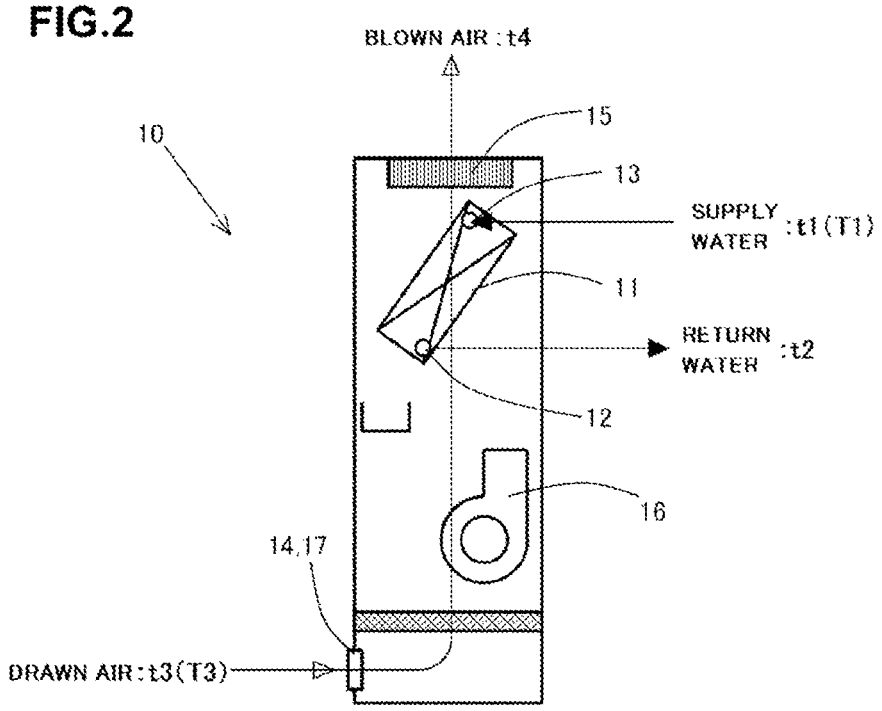
FIG. 2 is a cross-sectional view schematically illustrating an example of the FCU.

FIG. 2 is a cross-sectional view schematically illustrating an example of the fan coil unit 10. Although the illustrated FCU 10 is a floor-standing type, there is also a ceiling-embedded type. The FCU 10 causes a fan 16 to operate, thereby drawing air through an air inlet 14 in its lower part, causing the air to pass through a heat exchange coil 11, and then blowing out the air from its upper part. Supply water at the temperature t1 enters via an inlet of the heat exchange coil 11, and return water at the temperature t2 exits via an outlet thereof. The temperature sensor 17 is provided in the air inlet 14. This FCU configuration is publicly known.

Figure 3:
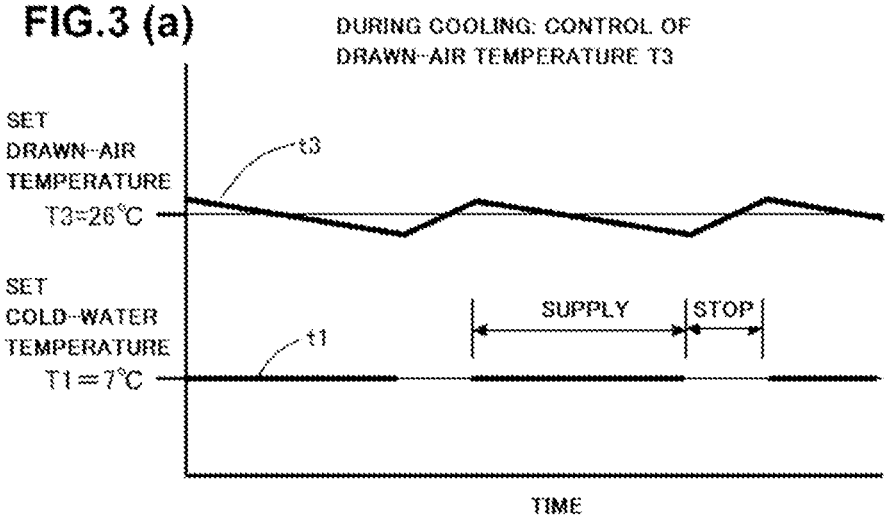
FIGS. 3(*a*) and (*b*) are graphs schematically illustrating control of a drawn-air temperature during cooling with cold water and heating with hot water, respectively.
Figure 3:
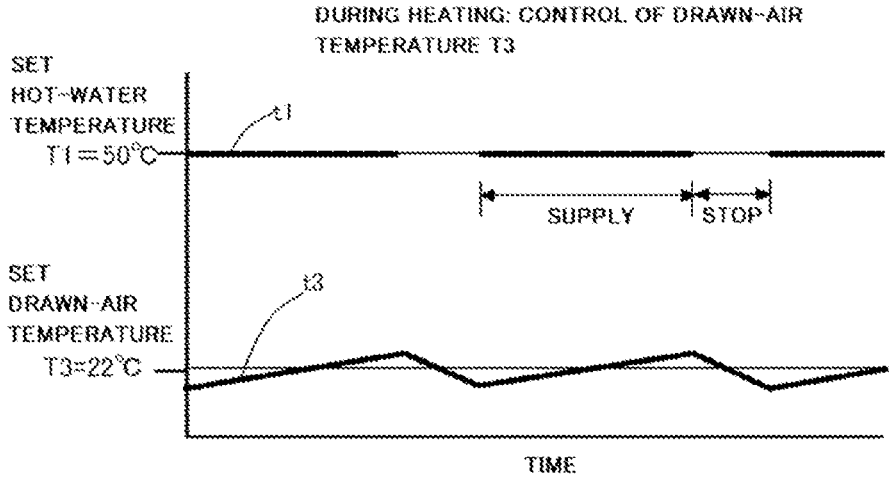

FIGS. 3(*a*) and (*b*) are graphs schematically illustrating control of the drawn-air temperature t3 of a fan coil unit during cooling and heating, respectively. As illustrated in FIG. 3(*a*), the cold-water temperature t1 is controlled to be the set cold-water temperature T1 that is constant (for example, 7° C.). A control device intermittently switches supply of cold water and stop of the supply in order to make the drawn-air temperature t3 detected by a temperature sensor coincident with the drawn-air temperature setting T3 (for example, 26° C.). Similarly, as illustrated in FIG. 3(*b*), the hot-water temperature t1 is controlled to the set hot-water temperature T1 that is constant (for example, 50° C.). The control device intermittently switches supply of the hot water and stop of the supply in order to make the drawn-air temperature t3 detected by the temperature sensor coincident with the drawn-air temperature setting T3 (for example, 22° C.). In any case, control is executed in such a manner that the drawn-air temperature t3 becomes the drawn-air temperature setting T3 that is constant, on time average.

Regarding control of operation of FCUs, design specification values of a plurality of parameters are determined for each of cooling and heating. In general, control of operation of FCUs is executed according to the design specification values that are constant over the entire period of cooling or heating. The water temperature setting T1 and the drawn-air temperature setting T3 are also included in these parameters. For example, as the design specification values for cooling, the set cold-water temperature T1 is 7° C., and the drawn-air temperature setting T3 is 26° C. As the design specification values for heating, the set hot-water temperature T1 is 50° C., and the drawn-air temperature setting T3 is 22° C. At present, these design specification values are not changed in the middle of the cooling period or the heating period of several months.

In particular, the influence of a heat load caused by outside air is large in the perimeter zone. Therefore, the time during which cold water or hot water is supplied varies with the magnitude of the heat load, resulting in a large change in the amount of heat transfer from the water to air by heat exchange in the FCU, that is, in heat consumption energy of the water. The inventors of the present application have found that in a case where the set supply-water temperature T1 and the drawn-air temperature setting T3 are always constant, wasteful heat consumption of the water increases especially during a period of light heat load. The present disclosure proposes to largely reduce heat consumption energy of water by appropriately changing these set temperatures T1 and T3 that have been fixed to the design specification values conventionally.

(2) Method for Calculating Heat Transfer Amount in Fan Coil Unit

First, in order to explain how the amount of heat transfer from water to air (heat consumption energy of water) in an FCU changes when the water temperature setting T1 and the drawn-air temperature setting T3 are changed to values other than their design specification values, a description is provided as to a method for calculating the amount H of heat transfer from cold water or hot water to the air in the FCU.

Figure 4:
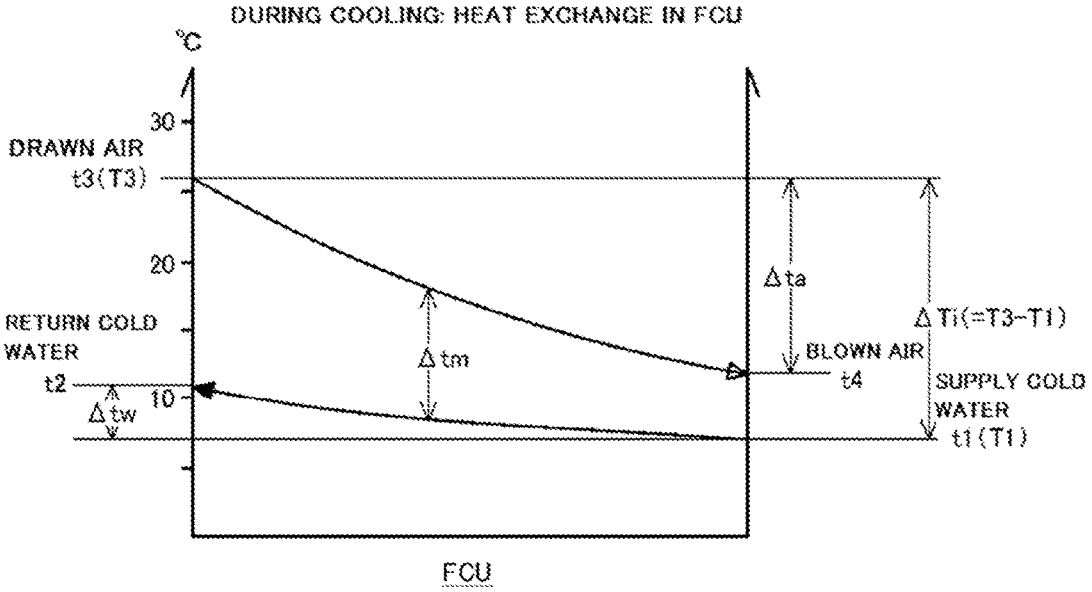
FIG. 4 is a graph illustrating temperature changes in cold water and air caused by heat exchange between them in an FCU during cooling.
Figure 5:
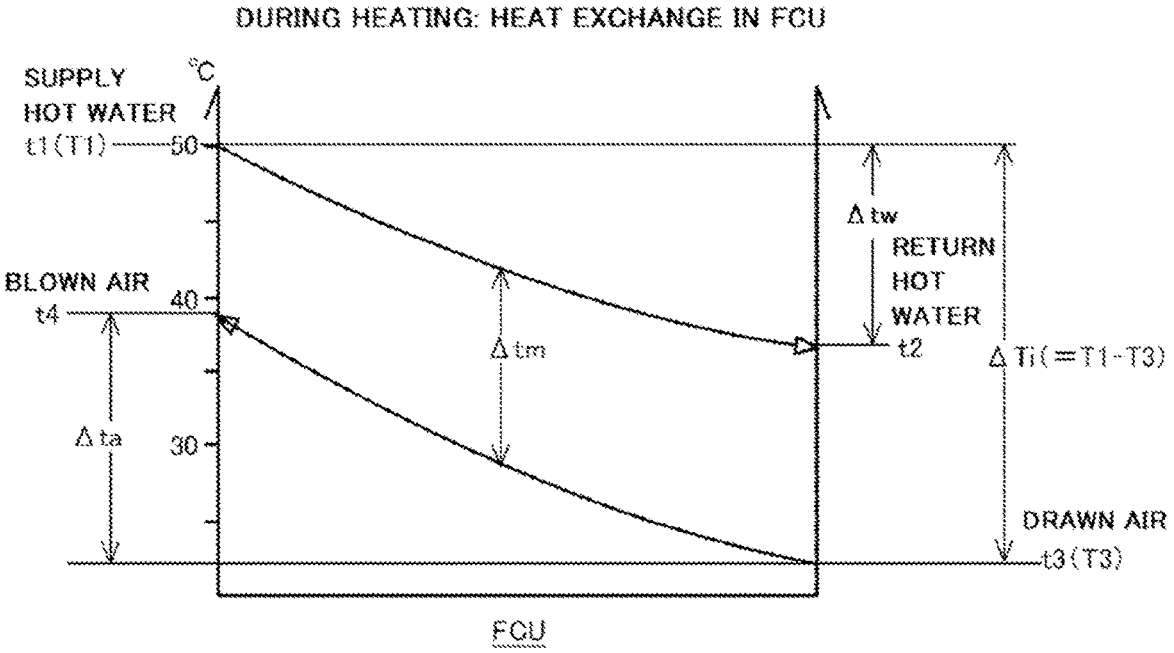
FIG. 5 is a graph illustrating temperature changes in hot water and air caused by heat exchange between them in an FCU during heating.

FIG. 4 is a graph illustrating temperature changes in cold water and air caused by heat exchange between them in an FCU (in a counterflow type) during cooling. While cold water and air pass in the FCU from an inlet to an outlet, the temperature of the cold water increases, and the temperature of the air decreases. FIG. 5 is a similar graph during heating. While hot water and the air pass through the FCU from the inlet to the outlet, the temperature of the hot water decreases, and the temperature of the air increases.

Figure 6:
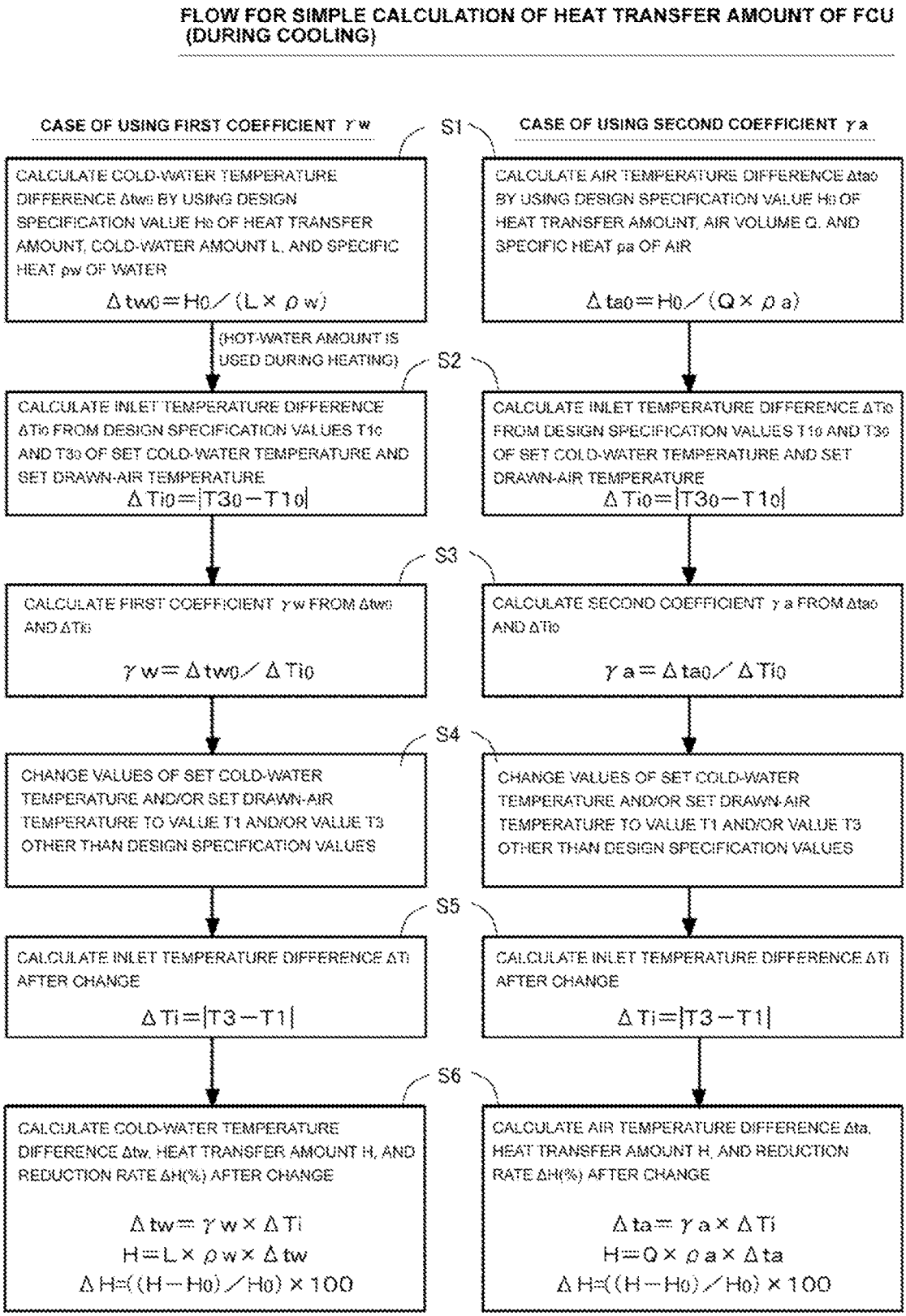
FIG. 6 is a flowchart illustrating a procedure of a method for calculating the amount of heat transfer from cold water to air in an FCU during cooling.

FIG. 6 is a flowchart illustrating a procedure of a method for calculating the amount of heat transfer from cold water to air in an FCU during cooling. The left flow in FIG. 6 represents a calculation method based on a change of the water, and the right flow represents a calculation method based on a change of the air. Both the flows provide the same result. A method for calculating the heat transfer amount during heating is substantially the same as that in FIG. 6, and therefore the illustration thereof is omitted. (In each of the following expressions, the set cold-water temperature T1 is always used as the cold-water temperature t1 in an inlet because the temperature t1 is controlled to be equal to the temperature T1. Similarly, the drawn-air temperature setting T3 is always used as the drawn-air temperature t3 because the temperature t3 is controlled to be equal to the temperature T3.)

(2-1) During Cooling (Summer)

A flow for calculating the amount H of heat transfer from cold water to air (heat consumption energy of cold water) in an FCU during cooling is described with reference to FIGS. 4 and 6. The following values are used as design specification values of parameters for the FCU during cooling as one example. Although each of the parameters of the design specification values is attached with a subscript "0", an air volume Q and a cold-water amount L do not have the subscript because they are not changed from the design specification values.

Heat transfer amount (cooling) $H_0$: 1300 kcal/h

Air volume Q: 500 $m^3$/h

Cold-water amount L: 360 kg/h

Set cold-water temperature $T1_0$: 7° C.

Drawn-air temperature setting $T3_0$: 26° C.

Step 1: For the design specification values, a temperature difference $\Delta tw_0$ that is a change of the temperature of cold water between an inlet and an outlet and a temperature difference $\Delta ta_0$ that is a change of the temperature of air between the inlet and the outlet are calculated.

A general expression for calculating a temperature difference of cold water Δtw (=t2−T1) is as follows.

$$\Delta tw = H/(L \times \rho w) \quad [1]$$

(ρw is a specific heat of water)

From Expression [1], a value of the temperature difference $\Delta tw_0$ when the respective parameters have the design specification values is as follows.

$$\Delta tw_0 = 1300/(360 \times 1) = 3.6° \text{ C.} \quad [2]$$

A general expression for calculating a temperature difference of air Δta (=t4-T3) is as follows.

$$\Delta ta = H/(Q \times \rho a) \quad [3]$$

(ρa is a specific heat of air)

From Expression [3], a value of the temperature difference $\Delta ta_0$ when the respective parameters have the design specification values is as follows.

$$\Delta ta_0 = 1300/(500 \times 0.288) = 9.0° \text{ C.} \quad [4]$$

Step 2: Here, a difference between the water temperature setting T1 and the drawn-air temperature setting T3 is defined as an "inlet temperature difference ΔTi" by the following expression.

$$\Delta Ti = |T3 - T1| \quad [5]$$

(The sign of the absolute value is given because ΔTi is T1-T3 during heating.)

From Expression [5], a value of the inlet temperature difference $\Delta Ti_0$ when the respective parameters have the design specification values is as follows.

$$\Delta Ti_0 = 26 - 7 = 19° \text{ C.} \quad [6]$$

Step 3: When the set cold-water temperature and the drawn-air temperature setting are changed from the design specification values $T1_0$ and $T3_0$ to other desired values T1 and T3, respectively, the heat transfer amount H also changes from its design specification value $H_0$ in association with that change. The cold-water temperature difference Δtw and the air temperature difference Δta also change from their design specification values $\Delta tw_0$ and $\Delta ta_0$, respectively. In the present disclosure, the concept of a first coefficient γw and a second coefficient γa is introduced in order to simply calculate the heat transfer amount H, the cold-water temperature difference Δtw, and the air temperature difference Δta at the desired set temperatures T1 and T3. The first coefficient γw and the second coefficient γa can be calculated by using the design specification values of the respective parameters. Steps 1 and 2 described above are preparation processes for such calculation. A method of calculating the coefficients γw and γa is described below.

It is assumed that the heat transfer amount H of cold water is equal to a heat transfer capability H of an FCU and the heat transfer amount H of air. That is, the cooling heat amount of the cold water is entirely transferred to the air via the FCU. The temperature difference between the cold water and the air in the FCU is (T3-T1) at most in the inlet of the FCU and (t4-t2) at least in the outlet. An average temperature difference between the water and the air that pass in the FCU is usually represented by a logarithmic mean temperature difference Δtm. The logarithmic mean temperature difference Δtm is calculated from the following Fourier's formula.

$$\Delta tm = ((T3 - t2) - (t4 - T1))/\ln\big((T3 - t2)/(t4 - T1)\big)$$

When the logarithmic mean temperature difference Δtm is calculated by using the above design specification values and Expressions [1] and [3], $$\Delta tm = ((26 - 10.6) - (17 - 7))/\ln((26 - 10.6)/(17 - 7)) = 12.5.$$

From Fourier's law, the cold-water temperature difference Δtw between the set cold-water temperature T1 and the return cold-water temperature t2 is in proportion to the heat transfer amount H of the cold water (Δtw∝H), and the logarithmic mean temperature difference Δtm in the FCU is also in proportion to the heat transfer capability H (Δtm∝H). Since the heat transfer amount H of the cold water and the heat transfer capability H of the FCU are equal to each other from the above assumption, a ratio Δtw/Δtm is constant.

Similarly, from Fourier's law, the air temperature difference Δta between the drawn-air temperature setting T3 and the blown-air temperature t4 is in proportion to the heat transfer amount H of the air ($\Delta ta \propto H$), and the logarithmic mean temperature difference $\Delta tm$ in the FCU is also in proportion to the heat transfer capability H ($\Delta tm \propto H$). Since the heat transfer amount H of the air and the heat transfer capability H of the FCU are equal to each other from the above assumption, a ratio $\Delta ta/\Delta tm$ is constant.

Further, from Fourier's law, the inlet temperature difference $\Delta Ti$ is in proportion to the heat transfer amount H of each of the cold water and the air ($\Delta Ti \propto H$), and the logarithmic mean temperature difference $\Delta tm$ in the FCU is also in proportion to the heat transfer capability H ($\Delta tm \propto H$). Since the heat transfer amount H of each of the cold water and the air and the heat transfer capability H of the FCU are equal to each other from the above assumption, a ratio $\Delta Ti/\Delta tm$ is constant.

When the above description is summarized, $$\Delta tw/\Delta tm = A_1 \quad [7]$$

$$\Delta ta/\Delta tm = A_2 \quad [8]$$

$$\Delta Ti/\Delta tm = A_3 \quad [9]$$

($A_1$, $A_2$, and $A_3$ are constants)

When $\Delta tm$ is eliminated from Expressions [7] and [9], the first coefficient $\gamma w$ is obtained.

$$\Delta tw/\Delta Ti = A_1/A_3 = \gamma w \quad [10]$$

When $\Delta tm$ is eliminated from Expressions [8] and [9], the second coefficient $\gamma a$ is obtained.

$$\Delta ta/\Delta Ti = A_2/A_3 = \gamma a \quad [11]$$

Expression indicates that the ratio $\gamma w$ of the cold-water temperature difference $\Delta tw$ to the inlet temperature difference $\Delta Ti$ is always constant even if those temperature differences are changed. Similarly, Expression indicates that the ratio $\gamma a$ of the air temperature difference $\Delta ta$ to the inlet temperature difference $\Delta Ti$ is always constant even if those temperature differences are changed.

The first coefficient $\gamma w$ is calculated as follows, based on values of $\Delta tw_0$ and $\Delta Ti_0$ respectively obtained from Expressions [2] and [6] by using the above design specification values.

$$\gamma w = \Delta tw_0/\Delta Ti_0 = 3.6/19 = 0.190 \quad [12]$$

Further, the second coefficient $\gamma a$ is calculated as follows, based on values of $\Delta ta_0$ and $\Delta Ti_0$ respectively obtained from Expressions [4] and [6] by using the above design specification values.

$$\gamma a = \Delta ta_0/\Delta Ti_0 = 9.0/19 = 0.475 \quad [13]$$

Step 4: Next, the set cold-water temperature and the drawn-air temperature setting are changed to the values T1 and T3 other than the design specification values $T1_0$ and $T3_0$, respectively.

Step 5: First, the inlet temperature difference $\Delta Ti$ after the change is calculated. For example, assuming that T1 is 8° C. and T3 is 25° C., $\Delta Ti = |T3 - T1| = 17°$ C.

Step 6: The two coefficients $\gamma w$ and $\gamma a$ are always constant even if each of the set temperatures T1 and T3 is changed to any value. When $\Delta Ti$ calculated in Step 5 and the values of $\gamma w$ and $\gamma a$ in Expressions and obtained in Step 3 are used, the cold-water temperature difference $\Delta tw$ after the change and the air temperature difference $\Delta ta$ after the change are calculated as follows.

$$\Delta tw = \gamma w \times \Delta Ti = 0.190 \times 17 = 3.23° \text{ C.} \quad [14]$$

$$\Delta ta = \gamma a \times \Delta Ti = 0.475 \times 17 = 8.08° \text{ C.} \quad [15]$$

Further, the heat transfer amount H after the change can be calculated by using Expression [1] or [3].

$$H = L \times \rho w \times \Delta tw = 360 \times 1 \times 3.23 = 1163 \text{ (kcal/h)} \quad [16]$$

$$H = Q \times \rho a \times \Delta ta = 500 \times 0.288 \times 8.08 = 1163 \text{ (kcal/h)} \quad [17]$$

The heat transfer amount H has the same value regardless of whether the first coefficient $\gamma w$ or the second coefficient $\gamma a$ is used.

Furthermore, a reduction rate $\Delta H$ of the heat transfer amount H after the change to the design specification value $H_0$ of the heat transfer amount is calculated as follows.

$$\Delta H(\%) = ((H - H_0)/H_0) \times 100(\%) \quad [18]$$

In this example, $\Delta H = -10.6\%$. (Reduction is indicated by a negative value in the present specification.)

As described above, by calculating first the first coefficient $\gamma w$ and the second coefficient $\gamma a$ from the design specification values, the cold-water temperature difference $\Delta tw$ and the air temperature difference $\Delta ta$ can be calculated immediately by using Expression or even if the set temperature T1 or T3 is changed to a value other than its design specification value. Further, the heat transfer amount H can be calculated by using Expression or [17], and the reduction rate $\Delta H$ can be calculated. When Expressions to are summarized, the following expressions are obtained.

$$H = L \times \rho w \times \gamma w \times \Delta Ti \quad [19]$$

$$H = Q \times \rho a \times \gamma a \times \Delta Ti \quad [20]$$

(2-2) During Heating (Winter)

Design specification values of respective parameters for an FCU during heating are as follows, as one example.

Heat transfer amount (heating) $H_0$: 2400 kcal/h

Air volume Q: 500 $m^3$/h

Hot-water amount L: 180 kg/h

Set hot-water temperature $T1_0$: 50° C.

Drawn-air temperature setting $T3_0$: 22° C.

FIG. 5 is a graph illustrating temperature changes of hot water and air caused by heat exchange between the hot water and the air in an FCU during heating. While the hot water and the air pass in the FCU from an inlet to an outlet, the temperature of the hot water decreases, and the temperature of the air increases.

Methods for calculating the hot-water temperature difference Δtw, the air temperature difference Δta, the heat transfer amount H, and the reduction rate ΔH when the design specification value $T1_0$ or $T3_0$ of the set temperature during heating is changed to another value T1 or T3 are the same as those during cooling represented in FIG. 6. Heating is different from cooling only in that consideration is made in such a manner that the hot-water temperature difference Δtw, the air temperature difference Δta, and the inlet temperature difference ΔTi have positive values (Steps 2 and 5). The description provided for cooling is also applied to heating as it is by replacing "cold water" with "hot water".

Figure 7:
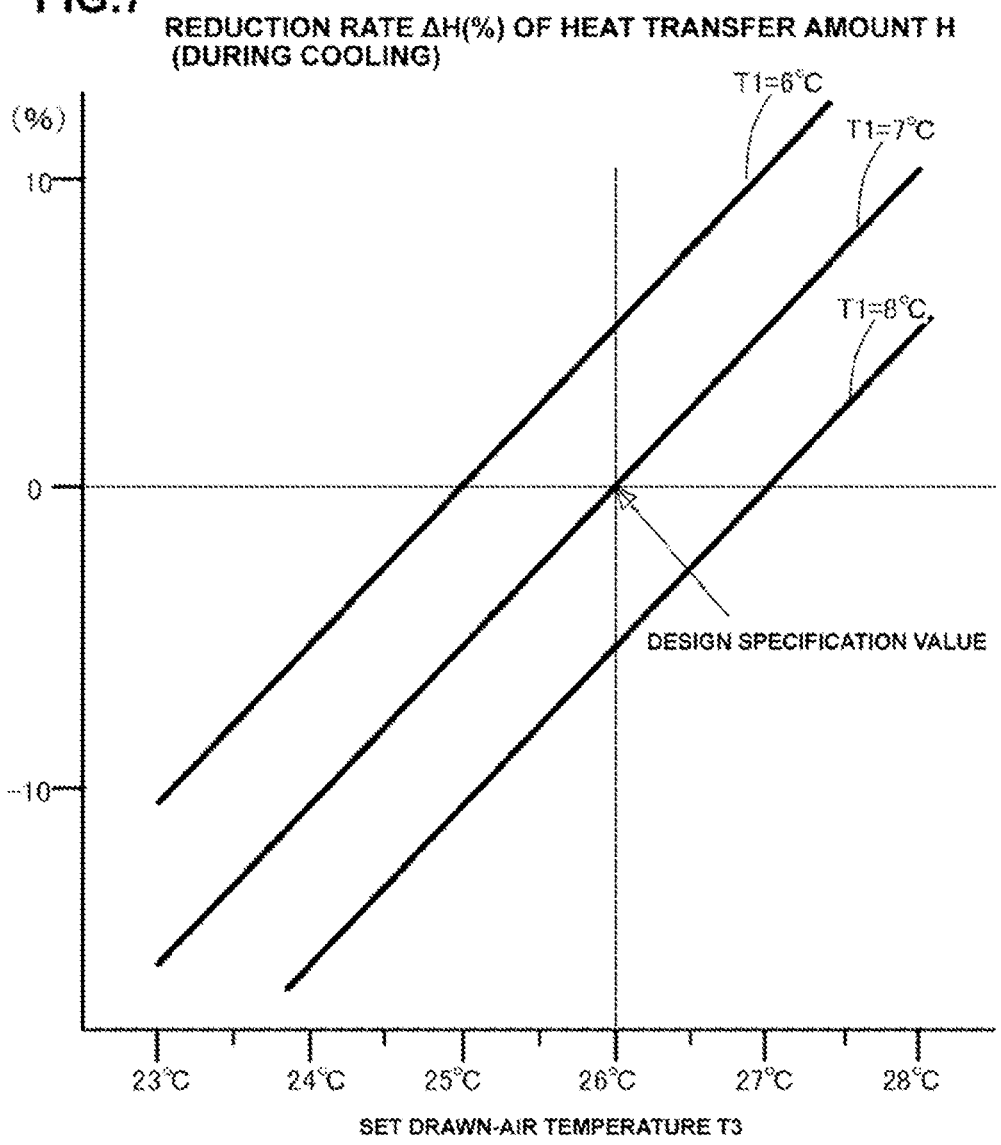
FIG. 7 is a graph illustrating increase/decrease in a reduction rate of the heat transfer amount during cooling calculated in accordance with the flow in FIG. 6.

FIG. 7 is a graph illustrating increase/decrease in the reduction rate ΔH of the heat transfer amount during cooling calculated in accordance with the flow in FIG. 6. The horizontal axis represents the drawn-air temperature setting T3, and the vertical axis represents the reduction rate ΔH of the heat transfer amount H to the design specification value $H_0$. Each straight line represents a change in the reduction rate ΔH when the set cold-water temperature T1 is made constant. As found from the graph, when the set cold-water temperature T1 is constant, the reduction rate ΔH (an absolute value of a negative value) of the heat transfer amount becomes larger as the drawn-air temperature setting T3 is made lower as compared to the design specification value. In addition, when the drawn-air temperature setting T3 is the same, the reduction rate ΔH of the heat transfer amount becomes larger as the set cold-water temperature T1 becomes higher. These facts indicate that the reduction rate ΔH of the heat transfer amount is larger as the inlet temperature difference ΔTi that is a difference between the set cold-water temperature T1 and the drawn-air temperature setting T3 is smaller. That is, as the temperatures of water and air that are to be heat-exchanged are closer to each other, the amount of heat transfer from the water to the air is smaller, so that heat consumption energy of the water is smaller.

Figure 8:
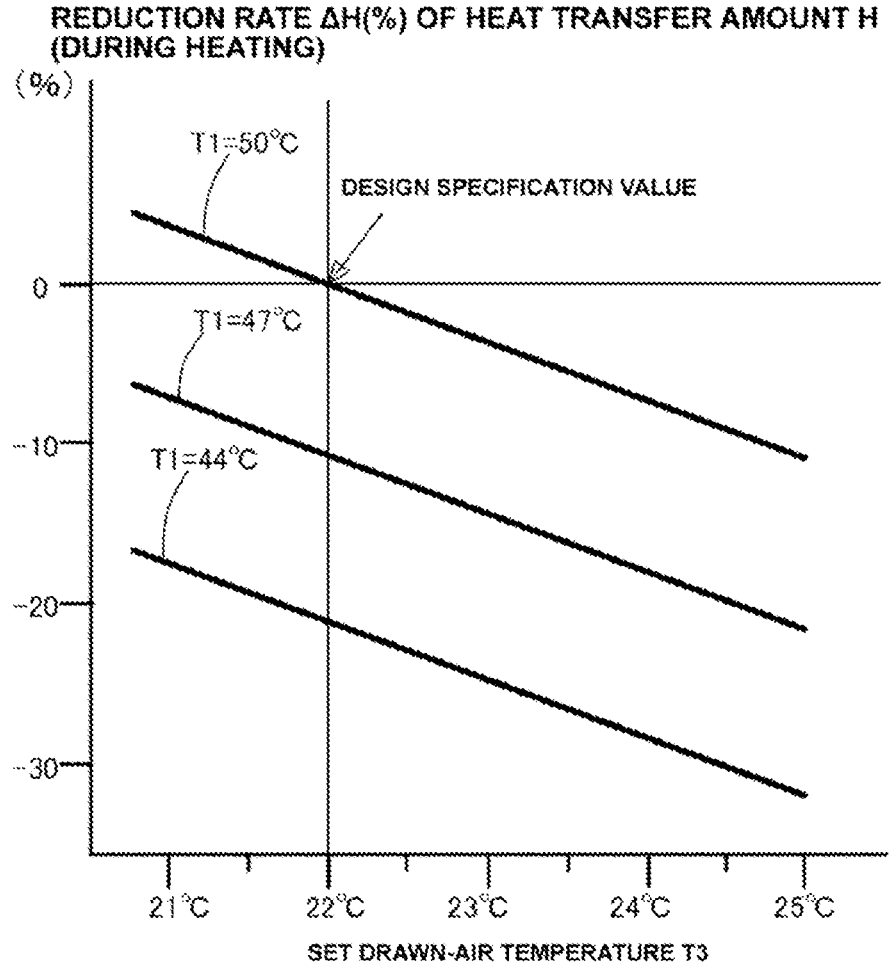
FIG. 8 is a graph similar to FIG. 7 during heating.

FIG. 8 is a graph similar to FIG. 7 but is related to heating. As found from the graph, when the set hot-water temperature T1 is constant, the reduction rate ΔH (an absolute value of a negative value) of the heat transfer amount becomes larger as the drawn-air temperature setting T3 is made higher as compared to the design specification value. In addition, when the drawn-air temperature setting T3 is the same, the reduction rate ΔH of the heat transfer amount becomes larger as the set hot-water temperature T1 becomes lower. These facts indicate that the reduction rate ΔH of the heat transfer amount is larger as the inlet temperature difference ΔTi that is a difference between the set hot-water temperature T1 and the drawn-air temperature setting T3 is smaller. Similarly to cooling, as the temperatures of water and air that are to be heat-exchanged are closer to each other, the amount of heat transfer from the water to the air is smaller, so that heat consumption energy of the water is smaller.

(3) Method for Determining Drawn-Air Temperature Setting T3 of Fan Coil Unit

From the findings indicated in FIGS. 7 and 8, it can be said that making the inlet temperature difference ΔTi between water and air in an FCU smaller contributes to reduction of the heat transfer amount H of the water. Based on this finding, the present disclosure proposes to reduce heat consumption energy of the water during cooling or heating by appropriately determining the water temperature setting T1 and the drawn-air temperature setting T3 of the FCU.

In cooling, the inlet temperature difference ΔTi can be made smaller by raising the set cold-water temperature T1 and/or lowering the drawn-air temperature setting T3, as compared to the respective design specification values. Meanwhile, in heating, the inlet temperature difference ΔTi can be made smaller by lowering the set hot-water temperature T1 and/or raising the drawn-air temperature setting T3, as compared to the respective design specification values.

A plurality of the drawn-air temperature settings T3 different from each other can be applied to a plurality of FCU groups, respectively. Meanwhile, regarding the water temperature setting T1, the same set temperature T1 is applied to all FCUs because water is supplied from one heat source device to all the FCUs.

Figure 9:
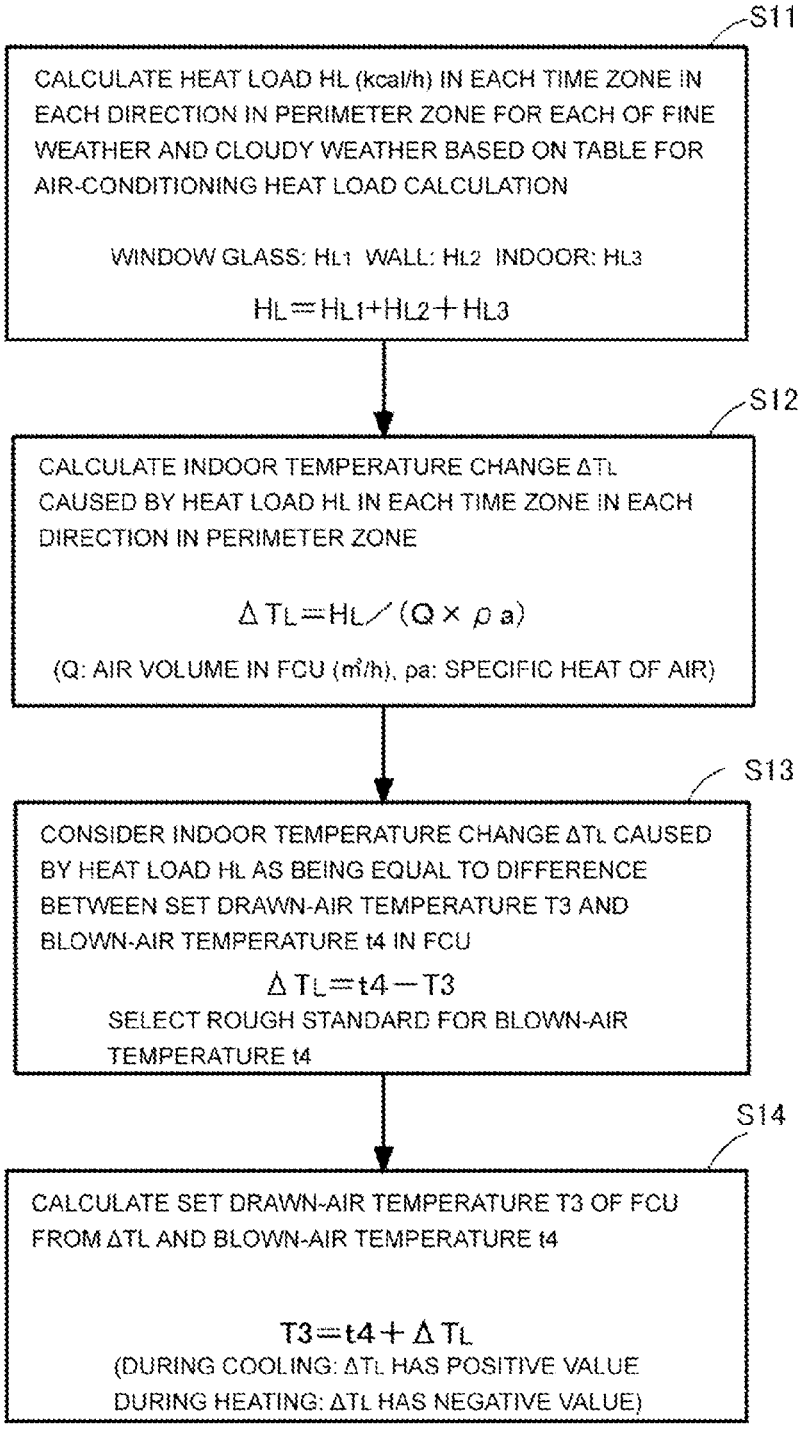
FIG. 9 is a flowchart schematically illustrating an example of a method for determining a drawn-air temperature setting for each of FCU groups.

FIG. 9 is a flowchart schematically illustrating an example of a method for determining the drawn-air temperature setting T3 for each of FCU groups divided by direction. In this example, the water temperature setting T1 is made constant. This determination flow is performed as a preparation process before FCUs actually operate. For example, this determination flow is performed using past data, predicted data, or the like before start of operation of the FCUs in summer or winter.

Step 11: For each of a sunny weather and a cloudy weather, a heat load $H_L$ in each time zone of the day in each direction in the perimeter zone is calculated. The heat load $H_L$ is the sum of heat $H_{L1}$ entering from window glass, heat $H_{L2}$ entering from a wall, and a load $H_{L3}$ from the inside of a room during cooling. During heating, heat entering from a window or wall is replaced with heat exiting therefrom. During cooling, $H_L$ usually has a positive value because of a large amount of entering heat. During heating, $H_L$ usually has a negative value because of a large amount of exiting heat. The method for calculating the heat load $H_L$ described above is publicly known, and a standard "table for air-conditioning load calculation" is also used widely.

The reason why the heat load $H_L$ is calculated for each of a sunny weather and a cloudy weather is that the weather largely affects the heat load $H_L$. Sunny weather and cloudy weather are examples of the weather. The heat load may be calculated for more than two different weather types. However, in a simple method, an average value of the heat loads $H_L$ for respective weather types may be used, in place of the heat load $H_L$ for each weather type.

The reason why the heat load $H_L$ is calculated for each time zone of the day is that the heat load $H_L$ changes depending on each time zone. The length of each time zone is, for example, one hour or two hours, and it is possible that the lengths of the respective time zones are not the same as each other. However, in a simple method, the same value may be used throughout the day, in place of the heat load $H_L$ in each time zone. In this case, it is preferable to use an average value of the heat loads $H_L$ in the respective time zones.

Further, the entire period of cooling or heating may be divided into periods of, for example, one month, a half month, or one week, and the heat load $H_L$ calculated for each period may be used.

Step 12: An indoor temperature change $\Delta T_L$ caused by the heat load $H_L$ calculated in Step 11 is calculated. This calculation can be performed according to Expression [3] described above.

$$\Delta T_L = H_L/(Q \times \rho a) \quad [21]$$

(Q: the air volume ($m^3$/h) in the FCU, pa: a specific heat of air)

Accordingly, the indoor temperature change $\Delta T_L$ caused by the heat load $H_L$ in each time zone in each direction in the perimeter zone is obtained. During cooling, $\Delta T_L$ has a positive value, and during heating, $\Delta T_L$ has a negative value.

Step 13: It is considered here that the indoor temperature change $\Delta T_L$ calculated in Step 12 is equal to a difference between the drawn-air temperature setting T3 and the blown-air temperature t4 of an FCU.

$$\Delta T_L = t4 - T3 \quad [22]$$

Since the blown-air temperature t4 is a temperature obtained as a result of heat exchange of drawn air in the FCU, the temperature t4 does not have a set value or a value that can be determined. However, the temperature t4 is selected as a rough standard for determining the set temperature T3 in this example. In a case of cooling, for example, $\Delta ta_0$ in Expression [4] described above using the design specification values is 9.0° C. Therefore, when 9.0° C. is subtracted from 26° C. that is the design specification value $T3_0$ of the drawn-air temperature setting, 17° C. is obtained as t4. At this time, this value is selected as a rough standard for the blown-air temperature t4. It is possible to change t4 as the rough standard later.

Step 14: The drawn-air temperature setting T3 is calculated from $\Delta T_L$ obtained in Step 12 and t4 selected in Step 13.

$$T3 = t4 + \Delta T_L \quad [23]$$

Accordingly, the drawn-air temperature setting T3 in each time zone in each direction in the perimeter zone is obtained. During cooling, $\Delta T_L$ has a positive value, and during heating, $\Delta T_L$ has a negative value.

Figure 10:
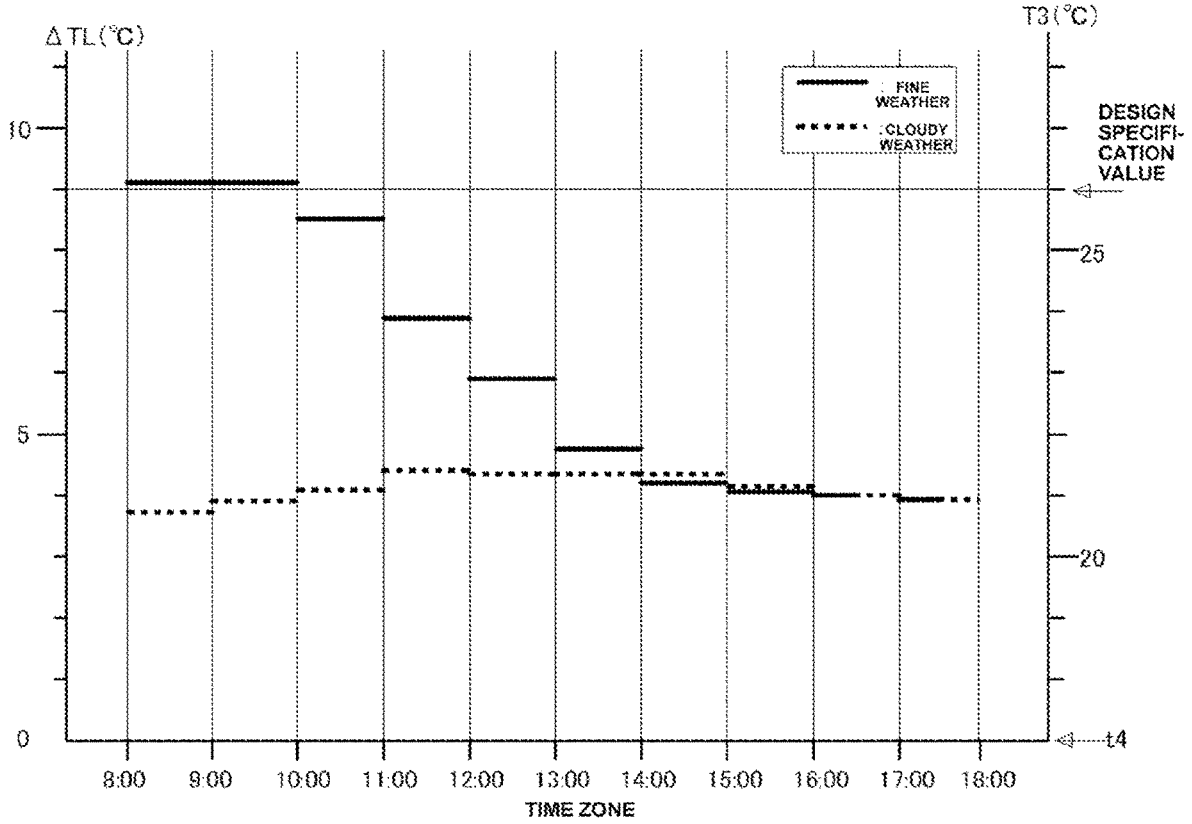
FIG. 10 is a graph illustrating an example of the drawn-air temperature setting during cooling in the southeast direction.

FIG. 10 is a graph illustrating an example of the drawn-air temperature setting T3 during cooling which is obtained in accordance with the determination flow in FIG. 9. FIG. 10 represents the set temperature T3 in each time zone for the southeast group in a case where FCUs in a perimeter zone are divided into groups based on four directions (southeast, southwest, northwest, and northeast). The left vertical axis represents $\Delta T_L$, and the right vertical axis represents the drawn-air temperature setting T3 calculated by Expression described above when 17° C. is selected as the blown-air temperature t4.

As illustrated in FIG. 7, during cooling, when the drawn-air temperature setting T3 is made lower than the design specification value (26° C.), heat consumption energy of water can be reduced (the set cold-water temperature T1 is constant at 7° C. in this example). From FIG. 10, it is found that the heat consumption energy can be reduced in most cases except for a time zone with a large heat load in sunny weather.

Figure 11:
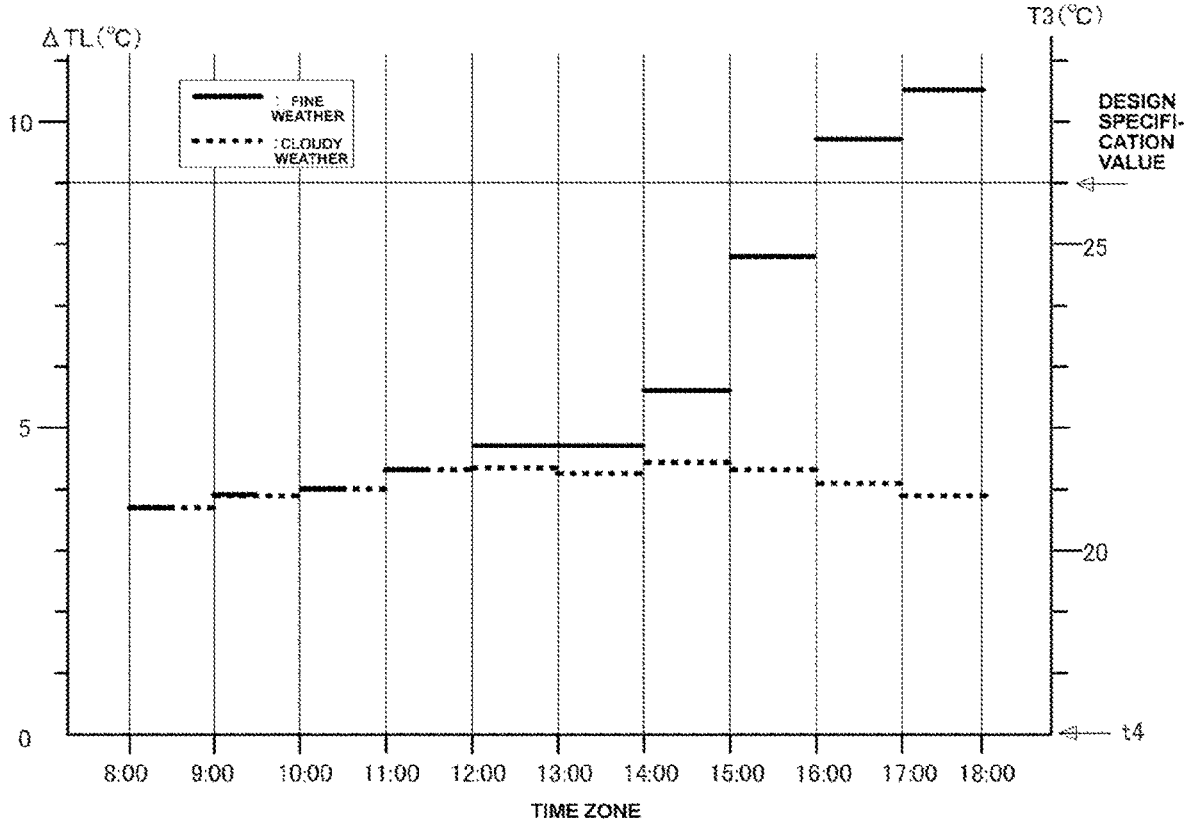
FIG. 11 is a graph illustrating an example of the drawn-air temperature setting during cooling in the northwest direction.

FIG. 11 is a graph similar to FIG. 10 but represents the drawn-air temperature setting T3 in each time zone for the northwest group. Also in this case, it is found that heat consumption energy can be reduced in most cases except for a time zone with a large heat load in sunny weather.

When the graph of FIG. 10 or FIG. 11 is obtained, if reduction of the heat consumption energy is determined to be insufficient, the procedure returns to Step 13 in FIG. 9, and the blown-air temperature t4 as a rough standard is lowered (for example, to 16° C.). Accordingly, the drawn-air temperature setting T3 is changed to a temperature by which the heat consumption energy is reduced.

Figure 12:
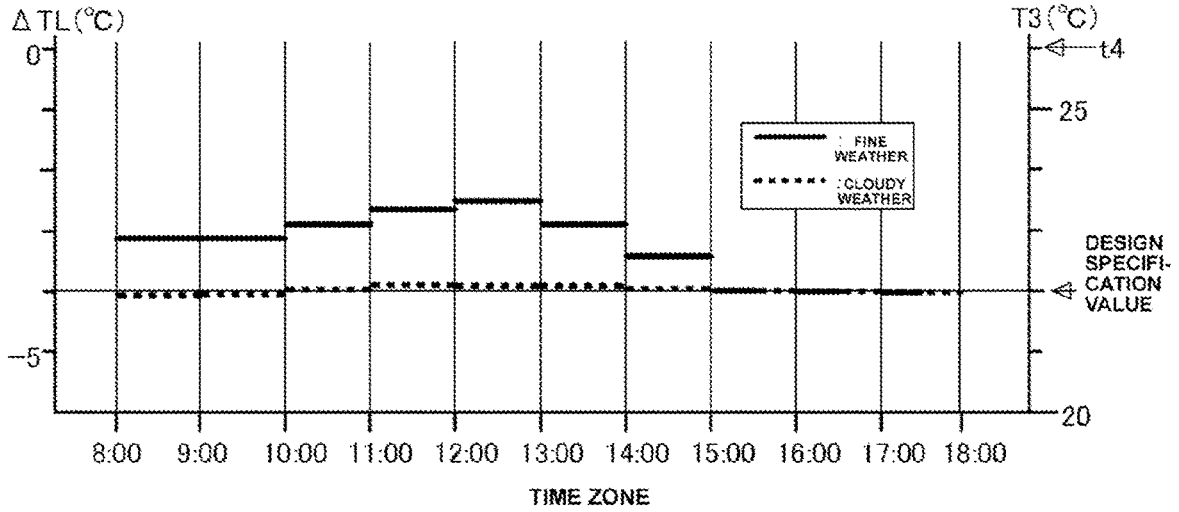
FIG. 12 is a graph illustrating an example of the drawn-air temperature setting during heating in the southeast direction.

FIG. 12 is a graph illustrating the drawn-air temperature setting T3 for the southeast group similarly to FIG. 10 but illustrating an example during heating. The left vertical axis represents $\Delta T_L$ (a negative value during heating), and the right vertical axis represents the drawn-air temperature setting T3 calculated by Expression described above when 26° C. is selected as a rough standard for the blown-air temperature t4.

As illustrated in FIG. 8, during heating, when the drawn-air temperature setting T3 is made higher than the design specification value, heat consumption energy of water can be reduced (the set hot-water temperature T1 is constant at 50° C. in this example). In the example of FIG. 12, although the drawn-air temperature setting T3 is not largely different from the design specification value, the drawn-air temperature setting T3 can be determined to reduce the heat consumption energy at least as compared to a case of the design specification value.

Figure 13:
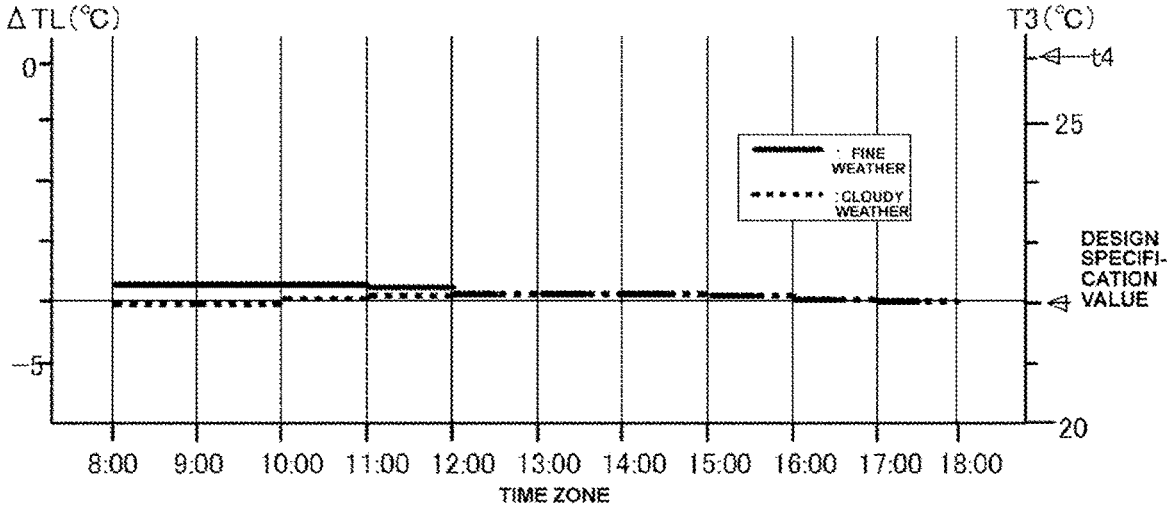
FIG. 13 is a graph illustrating an example of the drawn-air temperature setting during heating in the northwest direction.

FIG. 13 is a graph similar to FIG. 12 but represents the drawn-air temperature setting T3 in each time zone for the northwest group. In the example of heating indicated in FIGS. 12 and 13, it seems that the drawn-air temperature setting T3 does not need to be largely changed from the design specification value. However, this example is a mere example. The method according to the present disclosure can also be applied to heating, and changing the drawn-air temperature setting T3 may significantly contribute to energy saving depending on the condition of the perimeter zone.

The method for determining the drawn-air temperature setting T3 for each FCU group described above is a mere example. In a simple method, that temperature can be set to the same value throughout the day in place of being set for each time zone. In this case, it is preferable that an average value of the drawn-air temperature settings T3 in respective time zones represented in FIGS. 10 to 13 is used as the daily drawn-air temperature setting T3.

Furthermore, in addition to determination of the drawn-air temperature setting T3, by making the water temperature setting T1 higher during cooling or lower during heating, as compared to the design specification value, the heat consumption energy of the water in all the FCUs can be reduced. Final determination of the set temperatures T3 and T1 is made considering the balance between the reduction rate of the heat consumption energy and senses in a human body.

(4) Operation Flow of Fan Coil Units

Figure 14:
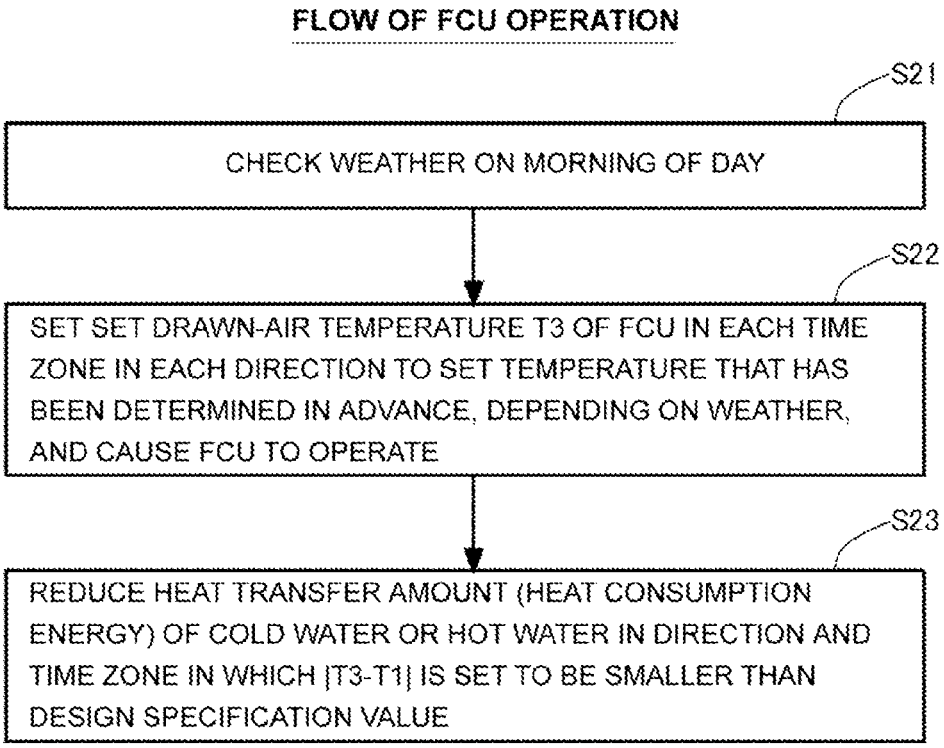
FIG. 14 schematically illustrates an example of an operation flow of FCUs.

FIG. 14 schematically illustrates an example of an operation flow of FCUs when cooling or heating is performed throughout the day. It is assumed that the drawn-air temperature setting T3 has been determined in advance in accordance with the determination flow in FIG. 9, and the water temperature setting T1 has also been determined in advance.

Step 21: On the morning of the day when the FCUs are caused to operate, whether the weather is fine or cloudy (or whether the weather is close to fine or cloudy) is checked.

Step 22: In the control device illustrated in FIG. 1, the drawn-air temperature setting T3 of the FCUs in each time zone in each direction is set to the set temperature that has been determined in advance, depending on the weather that has been checked. The drawn-air temperature setting T3 set before operation is not changed during the operation. The water temperature setting T1 is also changed if it is different from the design specification value. Thereafter, the operation of the FCUs is started. As illustrated in FIG. 3, supply of cold water or hot water to each FCU and stop of the supply are controlled based on the drawn-air temperature setting T3. The drawn-air temperature setting T3 can be set to the same value throughout the day in each direction, in place of being set for each time zone.

Step 23: After the operation is finished, the reduction amount of heat consumption energy of water can be evaluated based on operation records of a heat source device and the control device on the day. It is confirmed that the heat transfer amount of water (cold water or hot water) has been reduced in the direction and/or the time zone in which the absolute value of the difference between the drawn-air temperature setting T3 and the water temperature setting T1 is set to be smaller than the design specification value.

In the control method of the present disclosure, the drawn-air temperature setting T3 and the water temperature setting T1 that have been set before operation are not changed during the operation. Therefore, if attention is paid only to a certain day, the reduction amount of heat consumption energy may be insufficient. This state may occur, for example, if the weather forecast is wrong. However, when the reduction amount is averaged over a somewhat long period of time, such as a week, a half month, a month, or a season, significant reduction of heat consumption energy can be realized, as compared to a case where the control method of the present disclosure is not employed.

Respective embodiments illustrated and described here are only examples and the present disclosure is not limited thereto, and various modifications can be made thereto.

REFERENCE SIGNS LIST

10 FCU
11 heat exchange coil
12 supply water inlet
13 return water outlet
14 air inlet
15 air outlet
16 fan
17 temperature sensor

What is claimed is:

1. A method for controlling a plurality of fan coil units installed in a perimeter zone, each including a heat exchange coil (11) to which cold water or hot water is supplied and a fan (16) configured to draw indoor air, wherein the plurality of fan coil units cause the drawn air to be heat-exchanged with the cold water or hot water in the heat exchange coil (11), and thereafter blow out the drawn air into a room, the method comprising:

a first step of dividing the fan coil units into groups based on a direction of an installation position of each of the fan coil units and determining a predetermined respective drawn-air temperature setting (T3) for each of the groups in advance before operation of the fan coil units, wherein the first step includes determining the drawn-air temperature setting (T3) in each time zone of a day and determining the drawn-air temperature setting (T3) for each of days of different weather types; and a second step of, during the operation of the fan coil units, detecting a drawn-air temperature (t3) for each of the groups and controlling supply of the cold water or hot water to each of the fan coil units to make the drawn-air temperature (t3) coincident with the drawn-air temperature setting (T3) determined in advance for each of the groups, wherein the second step includes setting the drawn-air temperature setting (T3) in each time zone, which has been determined in advance, before operation of the fan coil units and thereafter causing the fan coil units to operate, and wherein the second step further includes setting the drawn-air temperature setting (T3), which has been determined in advance in accordance with a weather on a day when the fan coil units are caused to operate, before the operation of the fan coil units and thereafter causing the fan coil units to operate; and wherein the first step includes:

a third step of calculating a heat load ($H_L$) in each direction in the perimeter zone, and a fourth step of determining the drawn-air temperature setting (T3) for each group in accordance with the calculated heat load ($H_L$), wherein the fourth step includes a step of calculating an indoor temperature change ($\Delta T_L$) caused by the heat load ($H_L$), and a step of determining, as the drawn-air temperature setting (T3), a temperature higher than a rough standard for a blown-air temperature (t4) of the fan coil units by the indoor temperature change ($\Delta T_L$) while cooling is performed and a temperature lower than the rough standard for the blown-air temperature (t4) of the fan coil units by the indoor temperature change ($\Delta T_L$) while heating is performed.

2. The method for controlling fan coil units according to claim 1, wherein the first step further includes determining the drawn-air temperature setting (T3) for each of a period of cooling and a period of heating.

3. The method for controlling fan coil units according to claim 1, wherein the first step includes determining a set temperature (T1) of the cold water or hot water supplied to the fan coil units.

4. A method for calculating an amount of heat transfer (H) from water flowing through a heat exchange coil to air in a fan coil unit to which the method for controlling fan coil units according to claim 1 is applied, the calculating method comprising:

a step of calculating a first temperature difference ($\Delta tw_0$) that is a temperature change of the water between an inlet and an outlet of the fan coil unit by using a design specification value ($H_0$) of the heat transfer amount, a water amount of the cold water or hot water (L), and a specific heat ($\rho w$) of the water;

a step of calculating a second temperature difference ($\Delta Ti_0$) that is a difference between design specification values ($T1_0$, $T3_0$) of a water temperature setting and the drawn-air temperature setting;

a step of calculating a first coefficient (γw) that is a ratio of the first temperature difference ($\Delta tw_0$) and the second temperature difference ($\Delta Ti_0$); and a step of, when one or both of the water temperature setting and the drawn-air temperature setting are changed to a value (T1, T3) other than the design specification values, obtaining the heat transfer amount (H) by heat transfer amount ($H$)=water amount ($L$)×specific heat ($\rho w$) of water×first coefficient ($\gamma w$)×second temperature difference ($\Delta Ti$) after change.

5. A method for calculating an amount of heat transfer (H) from water flowing through a heat exchange coil to air in a fan coil unit to which the method for controlling fan coil units according to claim 1 is applied, the calculating method comprising:

a step of calculating a first temperature difference ($\Delta ta_0$) that is a temperature change of the air between an inlet and an outlet of the fan coil unit by using a design specification value ($H_0$) of the heat transfer amount, an air volume (Q), and a specific heat (ρa) of the air;

a step of calculating a second temperature difference ($\Delta Ti_0$) that is a difference between design specification values ($T1_0$, $T3_0$) of a water temperature setting and the drawn-air temperature setting;

a step of calculating a second coefficient (γa) that is a ratio of the first temperature difference ($\Delta ta_0$) and the second temperature difference ($\Delta Ti_0$); and a step of, when one or both of the water temperature setting and the drawn-air temperature setting are changed to a value (T1, T3) other than the design specification values, obtaining the heat transfer amount (H) by heat transfer amount ($H$)=air volume ($Q$)×specific heat ($\rho a$) of air×second coefficient ($\gamma a$)×second temperature difference ($\Delta Ti$) after change.

* * * * *